US010437173B2

(12) United States Patent
Ishizuka et al.

(10) Patent No.: US 10,437,173 B2
(45) Date of Patent: Oct. 8, 2019

(54) DEVELOPING DEVICE AND IMAGE FORMING DEVICE THAT MIXES DEVELOPING AGENT

(71) Applicant: Konica Minolta, Inc., Tokyo (JP)

(72) Inventors: Kazuteru Ishizuka, Saitama (JP); Hideaki Tanaka, Hussa (JP); Shunichi Takaya, Hino (JP); Shota Sakurai, Machida (JP); Kei Okamura, Yokohama (JP); Kei Yuasa, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/976,955

(22) Filed: May 11, 2018

(65) Prior Publication Data

US 2018/0335727 A1 Nov. 22, 2018

(30) Foreign Application Priority Data

May 19, 2017 (JP) ..... 2017-099703

(51) Int. Cl.
*G03G 15/08* (2006.01)

(52) U.S. Cl.
CPC ..... *G03G 15/0893* (2013.01)

(58) Field of Classification Search
CPC ..... G03G 15/0822; G03G 15/0887; G03G 15/0889; G03G 15/0891; G03G 15/0893
USPC ..... 399/254, 255, 256
See application file for complete search history.

(56) References Cited

U.S. PATENT DOCUMENTS 7,471,920 B2 * 12/2008 Akedo ..... G03G 15/0893 399/254
7,676,184 B2 * 3/2010 Murayama et al. ..... G03G 15/0877 399/255
7,715,764 B2 * 5/2010 Aimoto ..... G03G 15/0822 399/254
7,974,555 B2 * 7/2011 Okazaki et al. ... G03G 15/0893 399/254
9,442,426 B2 * 9/2016 Akedo ..... G03G 15/0893
10,139,755 B2 * 11/2018 Sakurai et al. .... G03G 15/0889
10,241,444 B2 * 3/2019 Okamura et al. .. G03G 15/0893

FOREIGN PATENT DOCUMENTS

JP S50-27333 U 3/1975
JP H03-260678 A 11/1991

* cited by examiner

*Primary Examiner* — William J Royer
(74) *Attorney, Agent, or Firm* — Osha Liang LLP

(57) ABSTRACT

A developing device includes a developing agent carrier body that carries a developing agent; a supplier that has a plurality of movement areas for moving the developing agent and that supplies the developing agent to the developing agent carrier body; a confluence path that combines the developing agent moving in each of the plurality of movement areas and thereafter returns the developing agent to the plurality of movement areas; and a mixing member that mixes the developing agent entered in the confluence path.

11 Claims, 12 Drawing Sheets

DEVELOPING DEVICE AND IMAGE FORMING DEVICE THAT MIXES DEVELOPING AGENT

CROSS-REFERENCE TO RELAYED APPLICATION

The entire disclosure of Japanese patent Application No. 2017-099703, filed on May 19, 2017, is incorporated herein by reference in its entirety.

BACKGROUND

Technical Field

The present invention relates to a developing device and an image forming device.

Description of Related Art

Generally, an image forming device (a printer, a copying machine, a facsimile, etc.) using an electrophotographic process technology irradiates (exposes) a charged photosensitive drum (image carrier) with laser light based on image data to form an electrostatic latent image. Then, toner is supplied from a developing device to the photosensitive drum on which the electrostatic latent image is formed, whereby the electrostatic latent image is visualized to form a toner image. Further, after this toner image is directly or indirectly transferred to a sheet, the toner image is formed on the sheet by heating, pressurizing, and fixing the toner image at a fixing nip.

The developing device has a stirring member for stirring a developing agent in the developing device. In the stirring member, it is known to stir the developing agent so that the developing agent moves in an axial direction of a developing sleeve. In such a configuration, for example, when the size of the developing device is increased in order to cope with a sheet which is long in the axial direction such as B1 size, the toner is mixed from an upstream side in the movement direction of the developing agent, and therefore, a deviation of the toner concentration in the axial direction tends to be large.

In order to deal with this event, for example, Japanese Examined Utility Model Registration Application Publication No. S50-27333 discloses a configuration in which a developing agent is circulated in each half area in a developing device in an axial direction. FIG. 1 is a diagram simply showing a developing device 412 in the conventional example.

As shown in FIG. 1, the developing device 412 has a developing sleeve 412A and a developing agent casing 412B. The developing agent casing 412B has a first stirring member 412C and a second stirring member 412D for stirring the developing agent in the developing agent casing 412B.

Each of the first stirring member 412C and the second stirring member 412D is formed such that a direction of a wing is reversed between a first area B1 on one side and a second area B2 on an other side with respect to a central portion in an axial direction of the developing sleeve 412A. As the first stirring member 412C and the second stirring member 412D rotate, the developing agent circulates along a flow of arrows B10 and B20 in each of the first area B1 and the second area B2.

JP H3-260678 A discloses a configuration in which a developing agent is positively caused to flow on both sides of the first area B1 and the second area B2 at a boundary between the first area B1 and the second area B2, whereby it is possible to suppress the occurrence of a difference in toner concentration between the first area B1 and the second area B2.

However, in the configuration shown in Japanese Examined Utility Model Registration Application Publication No. S50-27333, for example, in a case where images are formed in which an amount of toner is extremely larger in a portion corresponding to either one of the first area B1 and the second area B2 than in a portion corresponding to the other one of the first area B1 and the second area B2, only the toner concentration in the portion corresponding to the one of the first area B1 and the second area B2 extremely decreases. In the first area B1 and second area B2, the flows of the arrows B10 and B20 are generated, and therefore, the developing agent of the first area B1 and second area B2 is not reliably mixed, and the state of the developing agent of the first area B1 and second area B2 becomes ununiform.

In the configuration described in JP H3-260678 A, when the above image is continuously formed, toner concentration of either one of the first area B1 and the second area B2 extremely decreases, so that the other toner concentration decreases due to a decrease in one of the toner concentrations. As a result, the toner concentration decreases in the whole developing device from the beginning of the image forming process of the image, so it takes time for the toner concentration to recover the whole developing device. In other words, it takes time to uniformize the state of the developing agent in the first area B1 and the second area B2.

SUMMARY

A developing device and an image forming device according to one or more embodiments of the present invention efficiently uniformize the state of the developing agent in the axial direction of the developing device.

A developing device according to one or more embodiments of the present invention comprises: a developing agent carrier body that carries a developing agent; a supplier that has a plurality of movement areas for moving the developing agent and that supplies the developing agent to the developing agent carrier body; a confluence path that combines the developing agent moving in each of the plurality of movement areas and thereafter returns the developing agent to the plurality of movement areas; and a mixing member that mixes the developing agent entered in the confluence path.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
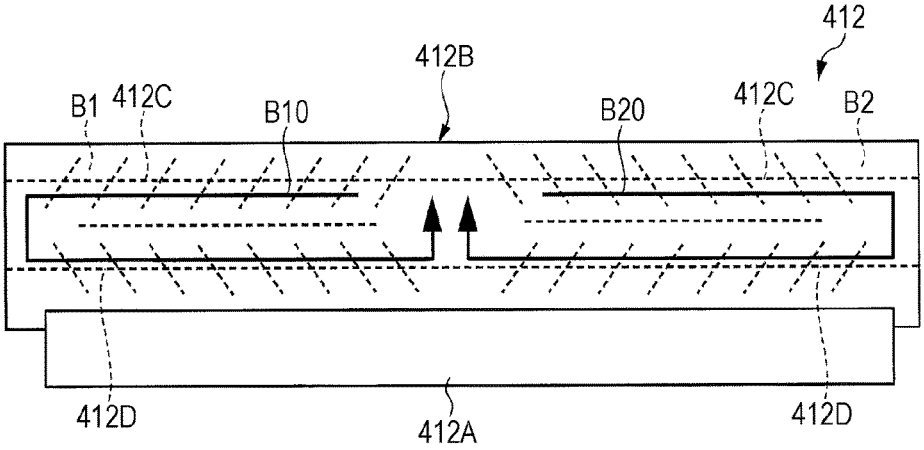
FIG. 1 (PRIOR ART)
FIG. 1 is a diagram simply showing a developing device in the conventional example.
Figure 2:
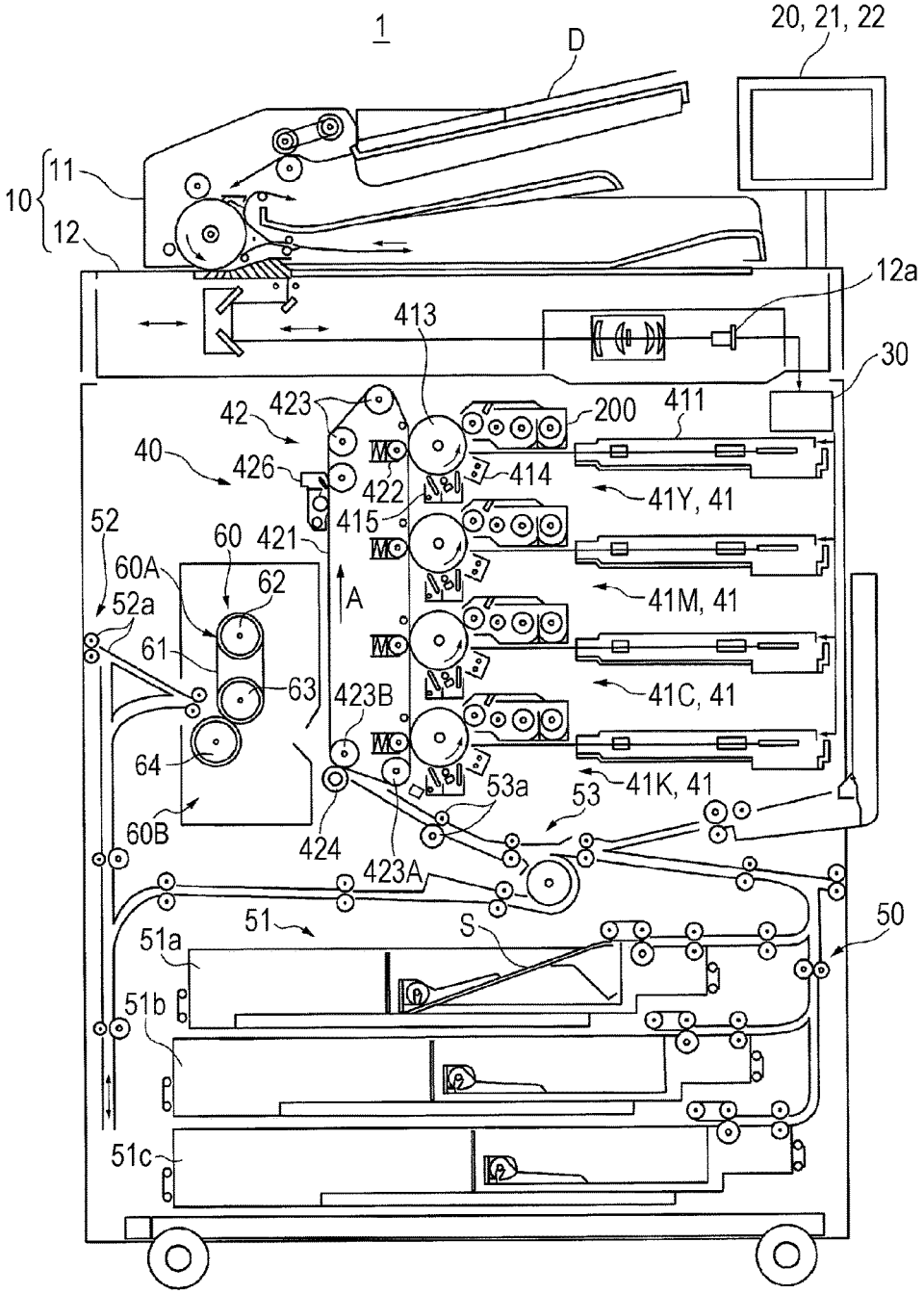
FIG. 2 is a diagram schematically showing an overall configuration of an image forming device according to one or more embodiments of the present invention.
Figure 3:
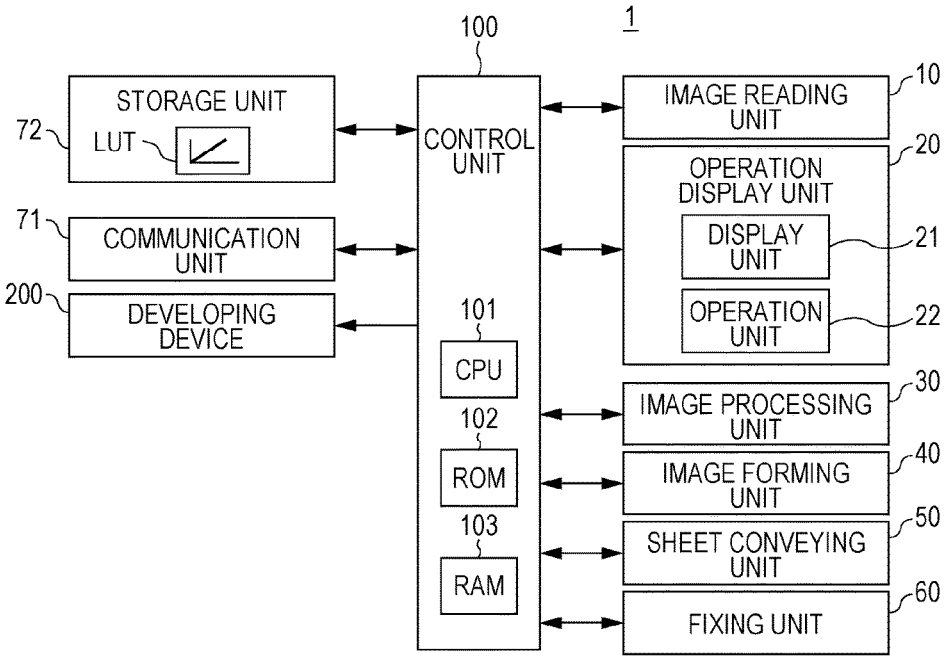
FIG. 3 shows a main portion of a control system of the image forming device according to one or more embodiments of the present invention.

Hereinafter, embodiments of the present invention will be described in detail with reference to the drawings. However, the scope of the invention is not limited to the disclosed embodiments. FIG. 2 is a diagram schematically showing an overall configuration of an image forming device 1 according to one or more embodiments of the present invention. FIG. 3 shows a main portion of a control system of the image forming device 1 according to one or more embodiments of the present invention.

The image forming device 1 shown in FIGS. 2 and 3 is a color image forming device of an intermediate transfer type using an electrophotographic process technology. That is, the image forming device 1 primarily transfers toner images of Y (yellow), M (magenta), C (cyan), and K (black) formed on photosensitive drums 413 to an intermediate transfer belt 421, and after the toner images of four colors are superimposed on the intermediate transfer belt 421, an image is formed by secondarily transferring the toner images to a sheet S.

The image forming device 1 adopts a tandem system in which the photosensitive drums 413 corresponding to four colors of YMCK are arranged in series in the traveling direction of the intermediate transfer belt 421 and toner images are sequentially transferred to the intermediate transfer belt 421 in a single procedure.

The image forming device 1 includes an image reading unit 10, an operation display unit 20, an image processing unit 30, an image forming unit 40, a sheet conveying unit 50, a fixing unit 60, and a control unit 100.

The control unit 100 includes a CPU (Central Processing Unit) 101, a ROM (Read Only Memory) 102, a RAM (Random Access Memory) 103, and the like. The CPU 101 reads a program corresponding to the processing contents from the ROM 102, develops the program in the RAM 103, and cooperates with the developed program to centrally control the operation of each block of the image forming device 1. At this time, various data stored in a storage unit 72 is referred to. The storage unit 72 is constituted by, for example, a nonvolatile semiconductor memory (so-called flash memory) or a hard disk drive.

The control unit 100 transmits and receives various data to and from an external device (for example, a personal computer) connected to a communication network such as LAN (Local Area Network), WAN (Wide Area Network), etc. via a communication unit 71. For example, the control unit 100 receives image data (input image data) transmitted from an external device, and causes sheet S to be formed with an image based on this image data. The communication unit 71 is constituted by a communication control card such as a LAN card, for example.

The image reading unit 10 includes an automatic document feeding device 11 and a document image scanning device 12 (scanner) which is called an ADF (Auto Document Feeder).

The automatic document feeding device 11 conveys a document D placed on a document tray by a conveying mechanism and feeds the document D to the document image scanning device 12. With the automatic document feeding device 11, it is possible to read images of a large number of documents D (including both sides) placed on the document tray one after another in a single operation.

The document image scanning device 12 optically scans the document D conveyed on a contact glass from the automatic document feeding device 11 or the document D placed on the contact glass, and forms reflected light from the document D on a light receiving surface of a CCD (Charge Coupled Device) sensor 12*a* to read a document image. The image reading unit 10 generates input image data based on the reading result by the document image scanning device 12. This input image data is subjected to predetermined image processing in the image processing unit 30.

The operation display unit 20 is constituted by, for example, a liquid crystal display (LCD) with a touch panel, and functions as a display unit 21 and an operation unit 22. According to a display control signal input from the control unit 100, the display unit 21 executes display of various operation screens, the state of the image, the operation state of each function, the information inside the image forming device 1, and the like. The operation unit 22 includes various operation keys such as numeric keys and a start key, accepts various input operations by the user, and outputs an operation signal to the control unit 100.

The image processing unit 30 includes a circuit or the like for executing digital image processing according to initial setting or user setting for input image data. For example, the image processing unit 30 executes gradation correction based on the gradation correction data (gradation correction table) under the control of the control unit 100. The image processing unit 30 applies various correction processing such as color correction and shading correction, compression processing, etc. as well as gradation correction to the input image data. Based on these processed image data, the image forming unit 40 is controlled.

The image forming unit 40 includes image forming units 41 (41Y, 41M, 41C, and 41K) for forming images with color toners of Y component, M component, C component, and K component based on the input image data, an intermediate transfer unit 42, and the like.

The image forming units 41Y, 41M, 41C, and 41K for Y component, M component, C component, and K component have the same configuration. For the sake of convenience and illustration, common components are denoted by the same reference numerals, and when the image forming units 41Y, 41M, 41C, and 41K are distinguished from each other, Y, M, C, or K is added to the reference numerals. In FIG. 2, only the constituent elements of the image forming unit 41Y for the Y component are denoted by reference numerals, and the reference numerals are omitted for the constituent elements of the other image forming units 41M, 41C, 41K.

The image forming unit 41 includes an exposure device 411, a developing device 200, the photosensitive drum 413, a charging device 414, a drum cleaning device 415, and the like.

The photosensitive drum 413 is a negatively charged type organic photosensitive (OPC: Organic Photo-Conductor) obtained by sequentially laminating an under coat layer (UCL), a charge generation layer (CGL), a charge transport layer (CTL), and the like on the circumferential surface of a conductive cylindrical body (aluminum raw tube).

The charging device 414 uniformly charges the surface of the photosensitive drum 413 having photoconductivity to negative polarity by generating corona discharge.

The exposure device 411 is composed of, for example, a semiconductor laser, and irradiates a laser beam corresponding to the image of each color component to a photosensitive drum 413. A positive charge is generated in the charge generation layer of the photosensitive drum 413 and transported to the surface of the charge transport layer, whereby the surface charge (negative charge) of the photosensitive drum 413 is neutralized. An electrostatic latent image of each color component is formed on the surface of the photosensitive drum 413 by the potential difference with the surroundings.

The developing device 200 is a two-component reversal type developing device, which visualizes the electrostatic latent image by attaching the toner of each color component to the surface of the photosensitive drum 413 to form a toner image. The developing device 200 forms a toner image on the surface of the photosensitive drum 413 by supplying the toner contained in the developing agent to the photosensitive drum 413.

The drum cleaning device 415 has a drum cleaning blade or the like that is in sliding contact with the surface of the photosensitive drum 413 and removes transfer residual toner remaining on the surface of the photosensitive drum 413 after primary transfer.

The intermediate transfer unit 42 includes the intermediate transfer belt 421, a primary transfer roller 422, a plurality of support rollers 423, a secondary transfer roller 424, a belt cleaning device 426, and the like.

The intermediate transfer belt 421 is formed of an endless belt, and is looped around a plurality of support rollers 423. At least one of the plurality of support rollers 423 is composed of a driving roller, and the other is composed of a driven roller. As the driving roller rotates, the intermediate transfer belt 421 runs at a constant speed in the direction A. The intermediate transfer belt 421 is a belt having conductivity and elasticity, and is rotationally driven by a control signal from the control unit 100.

The primary transfer roller 422 is disposed on the inner peripheral surface side of the intermediate transfer belt 421 so as to face the photosensitive drum 413 of each color component. A primary transfer nip for transferring a toner image from the photosensitive drum 413 to the intermediate transfer belt 421 is formed by pressing the primary transfer roller 422 against the photosensitive drum 413 across the intermediate transfer belt 421.

The secondary transfer roller 424 is disposed on the outer peripheral surface side of the intermediate transfer belt 421 so as to face a backup roller 423B disposed on the downstream side of a driving roller 423A in the belt traveling direction. A secondary transfer nip for transferring the toner image from the intermediate transfer belt 421 to the sheet S is formed by pressing the secondary transfer roller 424 against the backup roller 423B with the intermediate transfer belt 421 interposed therebetween.

The belt cleaning device 426 removes transfer residual toner remaining on the surface of the intermediate transfer belt 421 after the secondary transfer.

When the intermediate transfer belt 421 passes through the primary transfer nip, the toner image on the photosensitive drum 413 is sequentially overlaid on the intermediate transfer belt 421 to be primarily transferred. More specifically, a primary transfer bias is applied to the primary transfer roller 422, and a reverse bias voltage is applied to the back side of the intermediate transfer belt 421, i.e., the side in contact with the primary transfer roller 422, so that the toner image is electrostatically transferred to the intermediate transfer belt 421.

Thereafter, when the sheet S passes through the secondary transfer nip, the toner image on the intermediate transfer belt 421 is secondarily transferred to sheet S. More specifically, by applying a secondary transfer bias to the backup roller 423B and imparting charges of the same polarity as the toner to the front side of the sheet S, that is, the side in contact with the intermediate transfer belt 421, the toner image is electrostatically transferred onto the sheet S.

The fixing unit 60 has an upper side fixing unit 60A having a fixing surface member arranged on the surface where the toner image is formed which is the fixing surface of the sheet S and a lower side fixing unit 60B having a back surface side support member arranged on the surface opposite the fixing surface which is the back surface of the sheet S. By pressing the back surface side support member against the fixing surface member, a fixing nip that sandwiches and conveys the sheet S is formed.

By heating and pressurizing the sheet S with the fixing nip, the fixing unit 60 fixes the toner image onto the sheet S on which the toner image has been secondarily transferred and which has been conveyed.

The upper side fixing unit 60A has an endless fixing belt 61 which is a fixing surface member, a heating roller 62, and fixing roller 63. The fixing belt 61 is stretched around the heating roller 62 and the fixing roller 63.

The lower side fixing unit 60B has a pressurizing roller 64 which is a back surface side support member. The pressurizing roller 64 forms a fixing nip which conveys the sheet S between itself and the fixing belt 61.

The sheet conveying unit 50 includes a feeding unit 51, a sheet discharging unit 52, a conveying path 53, and the like. The sheets S (standard sheets, special sheets) identified on the basis of basis weight, size, etc. are accommodated according to the types set in advance in the three feeding tray units 51*a* to 51*c* constituting the feeding unit 51.

The conveying path 53 has a plurality of conveying roller pairs such as a resist roller pair 53*a* and the like. The sheets S accommodated in the feeding tray units 51*a* to 51*c* are fed one by one from the uppermost portion and are conveyed to the image forming unit 40 by the conveying path 53. At this time, the skew the fed sheet S is corrected and the conveying timing is adjusted by a resist roller portion provided with the resist roller pair 53*a*. Then, in the image forming unit 40, the toner image on the intermediate transfer belt 421 is secondarily transferred to one surface of the sheet S at one time and the fixing step is executed in the fixing unit 60. The formed sheet S is ejected out of the device by the sheet discharging unit 52 provided with a sheet ejection roller 52*a*.

Figure 4:
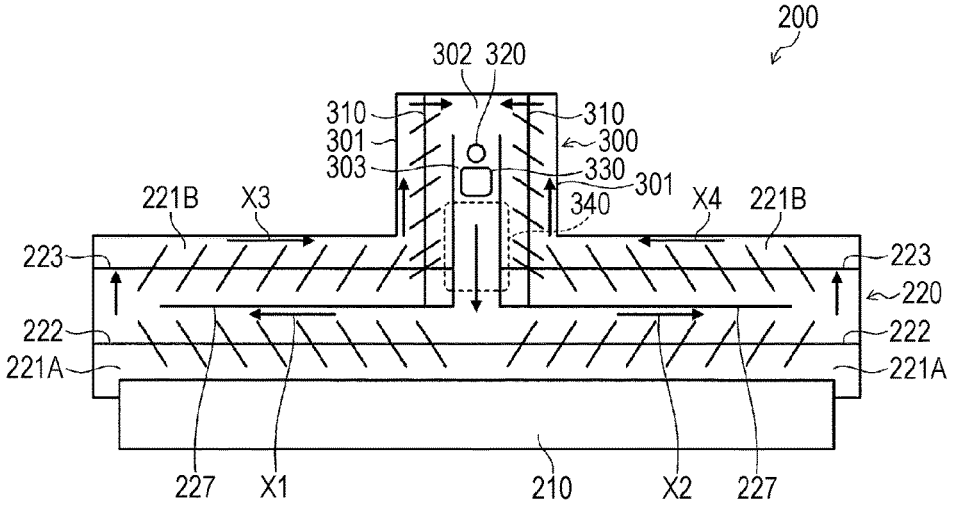
FIG. 4 is a diagram showing a developing device in a simplified manner according to one or more embodiments of the present invention.

Next, the developing device 200 will be described in detail. FIG. 4 is a diagram showing the developing device 200 in a simplified manner.

As shown in FIG. 4, the developing device 200 has a size capable of coping with a sheet long in the axial direction such as B1 size, and includes a developing sleeve 210, a developing agent casing 220, and a confluence path 300. The developing sleeve 210 is a developing agent carrier body carrying a developing agent and has a length corresponding to a sheet having a long axial length.

The developing agent casing 220 accommodates the developing agent supplied to the developing sleeve 210. The developing agent casing 220 corresponds to the "supplier" of one or more embodiments of the present invention.

The developing agent casing 220 includes a first area 221A which is an area on one side with respect to a portion corresponding to the central portion in the axial direction of the developing sleeve 210 and a second area 221B which is an area on the other side with respect to the portion corresponding to the central portion in the axial direction of the developing sleeve 210.

In each of the first area 221A and the second area 221B of the developing agent casing 220, a first stirring member 222 and a second stirring member 223 are provided.

The first stirring member 222 is provided in the portion facing the developing sleeve 210 in the first area 221A and the second area 221B, and supplies developing agent to developing sleeve 210 from first area 221A and second area 221B. The first stirring member 222 corresponds to a "supply member" according to one or more embodiments of the present invention.

The first stirring member 222 is configured such that the first stirring member 222 rotates to convey, in each of the areas 221A, 221B, the developing agent in the direction from the central portion of the developing sleeve 210 in the axial direction to the end portion located in each of the areas 221A, 221B (see arrows X1, X2).

The second stirring member 223 is provided at a portion farther from the developing sleeve 210 than the first stirring member 222 in the first area 221A and second area 221B. The second stirring member 223 is configured such that the second stirring member 223 rotates to convey, in each of the areas 221A, 221B, the developing agent in the direction to the central portion from the end portion located in each of the areas 221A, 221B of the developing sleeve 210 in the axial direction (see arrows X3, X4).

In each of the first area 221A and second area 221B, the area of the first stirring member 222 and the area of the second stirring member 223 are partitioned by a partition plate 227. With the partitioning of the partition plate 227, the area of the first stirring member 222 and the area of the second stirring member 223 in the first area 221A and the second area 221B are connected by the portion corresponding to the end of the first stirring member 222 and second stirring member 223.

Specifically, the area of the first stirring member 222 and the area of the second stirring member 223 in the first area 221A and the second area 221B and the central portion side in the axial direction of the first stirring member 222 and the second stirring member 223 are connected via the portions corresponding to the end portions at the opposite sides.

Therefore, in the first area 221A and the second area 221B, in the area of the first stirring member 222, the developing agent moves in the direction of the arrows X1 and X2, and thereafter, in the portion without the partition plate 227, the developing agent moves to the area of the second stirring member 223. After the developing agent moves to the area of the second stirring member 223, the developing agent moves in the directions of the arrows X3, X4 in that area.

Thus, in one or more embodiments of the present invention, the developing agent moves in each of the first area 221A and the second area 221B. The first area 221A and the second area 221B correspond to the "movement area" according to one or more embodiments of the present invention.

At the portion corresponding to the central portion of the axial direction in the developing agent casing 220, the confluence path 300 is provided. The confluence path 300 is a portion for combining and mixing the developing agent in the first area 221A and the developing agent in the second area 221B.

The confluence path 300 is provided separately in the first area 221A and the second area 222B in the developing agent casing 220, and is in communication with the central portion of the axial direction in the area of the second stirring member 223, and in communication with the central portion of the axial direction in the area of the first stirring member 222.

As a result, in the area of the second stirring member 223, the developing agent having moved to the central portion of the axial direction moves to the central portion of the axial direction in the area of the first stirring member 222 via the confluence path 300, and is returned back to the first area 221A and the second area 221B.

Therefore, the developing agent in the first area 221A and the second area 221B is mixed by the confluence path 300 and returned to the first area 221A and the second area 221B. Therefore, the developing agent in the first area 221A and the second area 221B can be made uniform.

The confluence path 300 includes a conveying area 301, a confluence area 302, and a mixing area 303. The confluence path 300 is provided with a conveying member 310, a toner concentration detector 320, a toner replenisher 330, and a mixing member 340.

Figure 5:
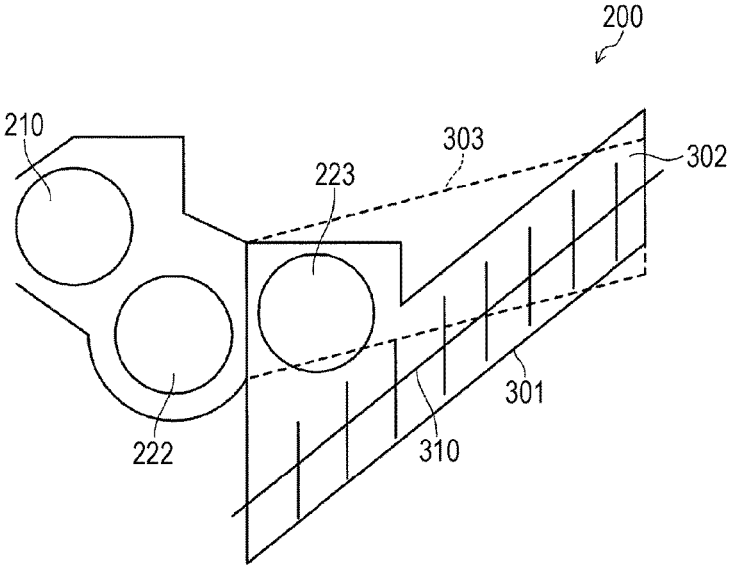
FIG. 5 is a diagram simply showing a cross section of a conveying area portion of the developing device of FIG. 4.

The conveying area 301 is an area that conveys the developing agent in the developing agent casing 220 to the confluence area 302. As shown in FIG. 5, the conveying area 301 is an area extending from the position below the second stirring member 223 diagonally upward to the right in the drawing and leading to the confluence area 302.

In the conveying area 301, a conveying member 310 is provided. The conveying member 310 has substantially the same configuration as the first stirring member 222 and the second stirring member 223, and is configured to rotate to convey the developing agent in the conveying area 301 to the confluence area 302.

Figure 6:
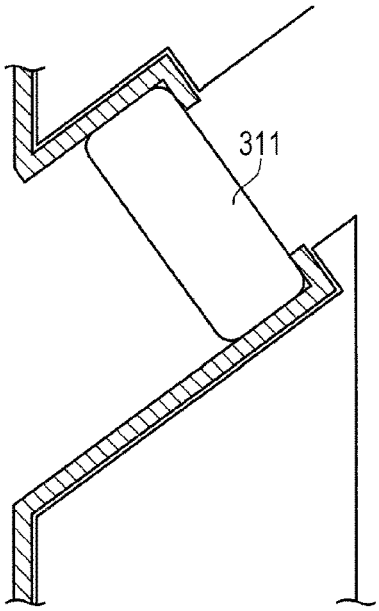
FIG. 6 is an enlarged view of the end of a conveying member according to one or more embodiments of the present invention.

As shown in FIG. 6, a bearing 311 is provided at the end of the conveying member 310. A portion corresponding to the end portion of the confluence path 300 is configured to be able to embed the bearing 311 in an oblique direction. This makes it possible for the conveying member 310 to rotate smoothly and to convey the developing agent diagonally upward.

As shown in FIG. 4, the confluence area 302 is an area which combines the developing agent conveyed from the conveying area 301 connected to each of the first area 221A and the second area 221B, and is configured to connect the ends of each conveying area 301. The confluence area 302 is connected to the mixing area 303. Therefore, the developing agent conveyed to the conveying areas 301 is combined in the confluence area 302 and moved to the mixing area 303.

Figure 7:
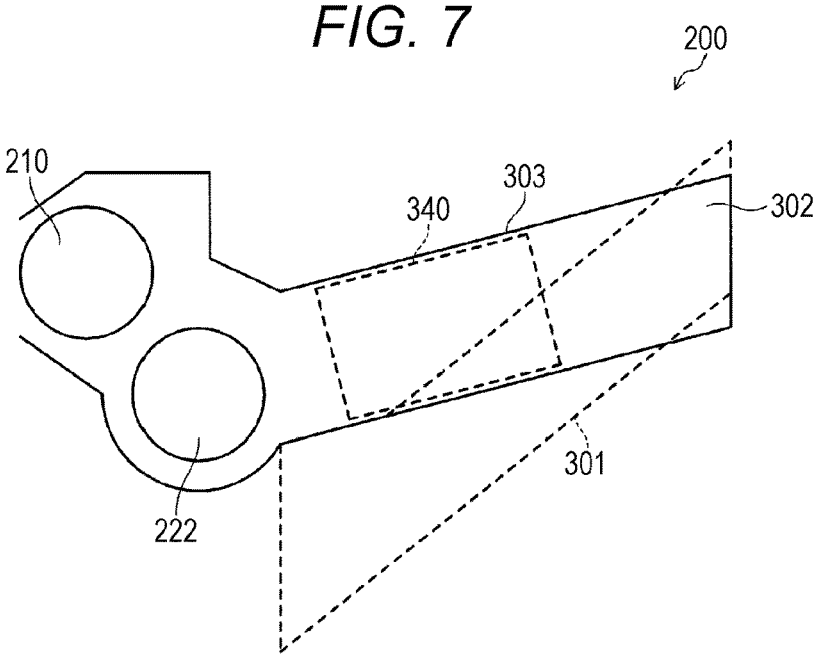
FIG. 7 is a diagram simply showing a cross section of a mixing area portion of the developing device of FIG. 4.

As shown in FIG. 7, the mixing area 303 is a portion extending, in the figure, diagonally downward to the left from the portion connecting each conveying area 301 in the confluence area 302 and leading to the developing agent casing 220. The developing agent moved to the mixing area 303 flows down to the developing agent casing 220 along the shape of the mixing area 303.

As a result, the developing agent mixed by the confluence path 300 can be moved to the first area 221A and the second area 221B in the developing agent casing 220. Since the confluence path 300 has a difference in height with respect to the developing agent casing 220 in this manner, the movement of the developing agent in the confluence path 300 can be realized with a relatively simple configuration.

Figure 8:
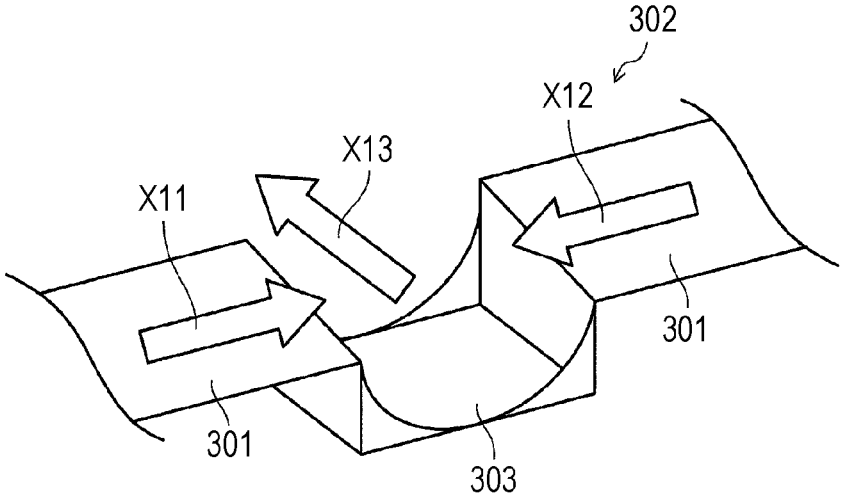
FIG. 8 is an enlarged view of a confluence area portion according to one or more embodiments of the present invention.

As shown in FIG. 8, the mixing area 303 is formed to be one step lower than the conveying area 301. As a result, the developing agent (see arrows X11 and X12) which is conveyed from the conveying area 301 to the confluence area 302 becomes easy to move due to its own weight to the mixing area 303, and the developing agent (see arrow X13) can be easily moved in the direction in which the mixing area 303 extends.

As shown in FIG. 4, the conveying area 301 and mixing area 303 extends in a direction substantially orthogonal to the axial direction of the developing sleeve 210. Note that the substantially perpendicular direction here includes a range of ±5 degrees from the direction of 90 degrees with respect to the axial direction.

As a result, it is possible to make the developing agent entering the confluence path 300 substantially the same in the first area 221A and the second area 221B, so that it is possible to suppress the occurrence of a difference in the amount of developing agent in the first area 221A and the second area 221B.

In the mixing area 303, the toner concentration detector 320, the toner replenisher 330, and the mixing member 340 are provided in this order from the upstream side in the movement direction of the developing agent.

The toner concentration detector 320 detects the toner concentration in the developing agent moved to the mixing area 303. The toner replenisher 330 replenishes the toner in the mixing area 303. The control unit 100 controls the replenishment amount of toner in the toner replenisher 330 based on the detection result detected by the toner concentration detector 320.

In this way, since the toner concentration detector 320 is positioned upstream of the toner replenisher 330 in the movement direction of the developing agent, it is possible to execute the toner replenishment in view of the detection result of the toner concentration detector 320.

The mixing member 340 is a member for mixing the developing agent that has entered the mixing area 303. The mixing member 340 mixes the developing agent by imparting resistance to the movement of the developing agent so that the developing agent in the mixing area 303 mixes uniformly.

The mixing member 340 is located on the downstream side of the toner replenisher 330 in the movement direction of the developing agent. Therefore, after uniformly mixing the developing agent after the toner replenishment is executed, the developing agent can be returned to the first area 221A and the second area 221B.

Figure 9:
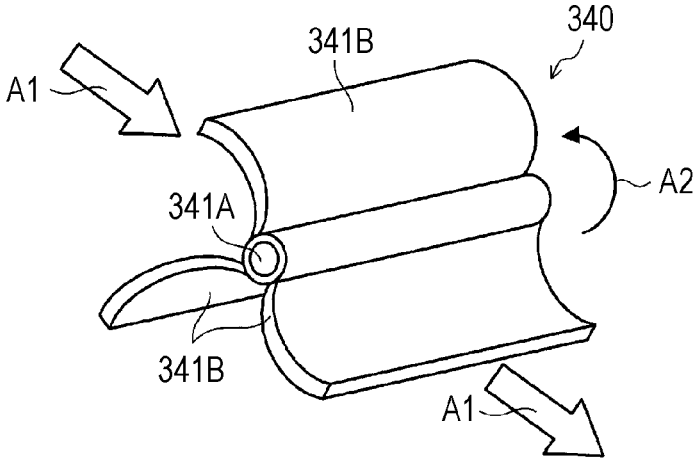
FIG. 9 shows an example of a mixing member according to one or more embodiments of the present invention.

As the mixing member 340, for example, as shown in FIG. 9, a rotating member that rotates along the movement direction of the developing agent (arrow A1) can be mentioned. The mixing member 340 has a rotating shaft 341A that rotates in a direction (arrow A2) along the movement direction and three blades 341B provided on the circumferential surface of the rotating shaft 341A.

The blade 341B is constructed so as to pump up the developing agent. The mixing member 340 rotates with the movement of the developing agent and conveys the developing agent along the movement direction while the blade 341B scoops up the developing agent. As a result, the developing agent in the mixing area 303 is mixed and eventually, uniformly mixed.

Figure 10:
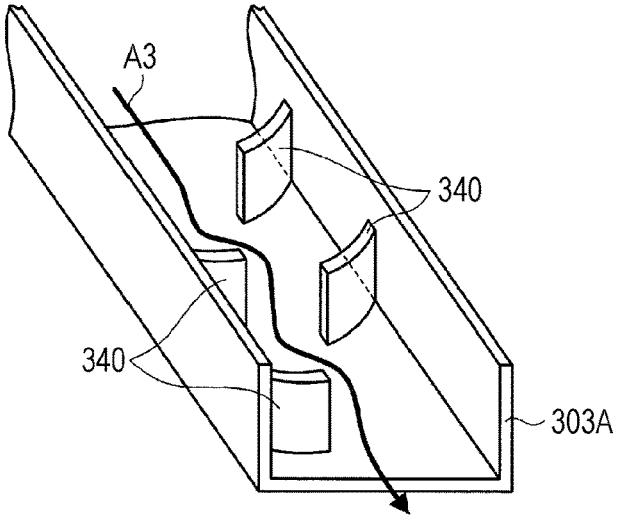
FIG. 10 shows an example of the mixing member according to one or more embodiments of the present invention.

As the mixing member 340, for example, as shown in FIG. 10, there is a member configured to move with the developing agent meandering. The mixing member 340 protrudes from each of a pair of side walls 303A forming the mixing area 303.

Each of the mixing members 340 is provided at a different position in the movement direction (arrow A3). As a result, the developing agent moving in the mixing area 303 collides with the mixing member 340, so that the developing agent moves in a meandering manner, and in turn the developing agent in the mixing area 303 mixes uniformly.

Figure 11:
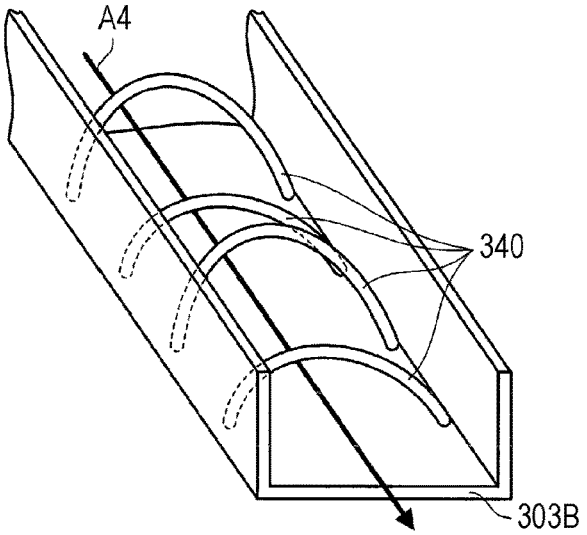
FIG. 11 shows an example of the mixing member according to one or more embodiments of the present invention.

As a mixing member 340, for example, as shown in FIG. 11, a semicircular member provided in the bottom wall 303B of the mixing area 303 can be mentioned. A plurality of mixing members 340 are arranged side by side in the movement direction (arrow A4) of the developing agent. Among the plurality of mixing members 340, two mixing members 340 adjacent in the movement direction have different heights.

More specifically, a mixing member 340 on the high height side and a mixing member 340 on the low height side are alternately arranged. As a result, the developing agent flowing through the mixing area 303 comes into contact with each of the mixing members 340 having different heights, whereby the developing agent is mixed and eventually, uniformly mixed.

Like the first stirring member 222, the second stirring member 223, and conveying member 310, As the mixing member 340 may be a member capable of stirring the developing agent.

According to the embodiments configured as described above, the developing agent in the first area 221A and the second area 221B can be made uniform through the confluence path 300. Therefore, it is possible to efficiently homogenize the state of the developing agent in the entire axial direction of the developing device 200.

Further, since the confluence path 300 is provided separately for the first area 221A and the second area 221B, it is possible to reliably mix the combined developing agent via the mixing area 303. Therefore, it is possible to efficiently uniformize the developing agent in the first area 221A and the second area 221B.

Further, since the mixing member 340 is provided in the confluence path 300, it is possible to efficiently mix the developing agent that has entered the confluence path 300.

Figure 12:
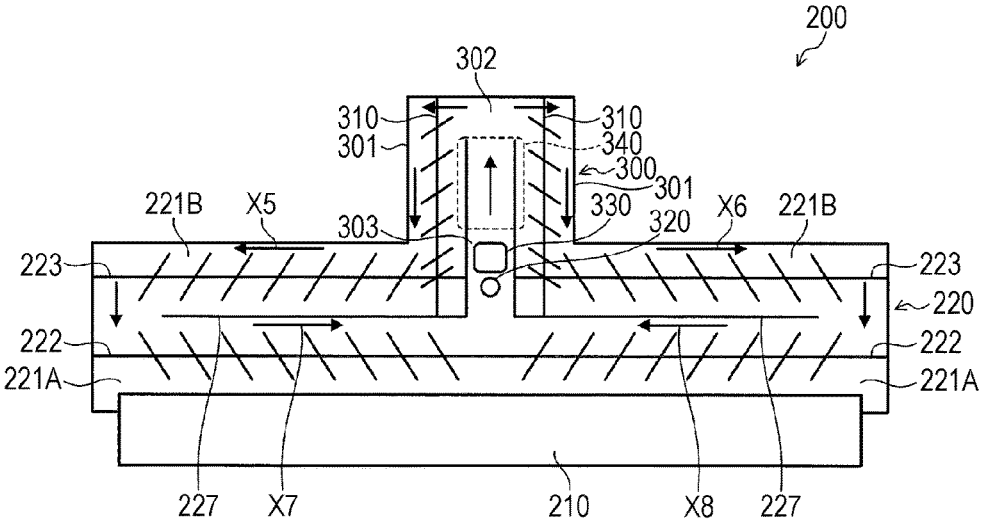
FIG. 12 is a diagram simply showing a developing device related to a modification of one or more embodiments of the present invention.

Next, the first modification will be explained. FIG. 12 is a diagram simply showing the developing device 200 according to the first modification. As shown in FIG. 12, the developing device 200 according to the first modification has a developing sleeve 210, a developing agent casing 220, and a confluence path 300 similarly to the above-mentioned embodiments.

The developing sleeve 210 and developing agent casing 220 have substantially the same configuration as the above-mentioned embodiments. The confluence path 300 has a conveying area 301, a confluence area 302, and a mixing area 303 similarly to the above-mentioned embodiments.

The first stirring member 222 and the second stirring member 223 are configured so that the conveying direction of the developing agent is opposite to the above-mentioned embodiments. Therefore, the second stirring member 223 conveys the developing agent in the direction from the central portion of the developing sleeve 210 in the axial direction toward the end (see arrows X5, X6), and in the portion without the partition plate 227, the developing agent moves to the area of the first stirring member 222. Then, the first stirring member 222 conveys the developing agent in the direction from the end of the developing sleeve 210 toward the central portion in the axial direction (see arrows X7 and X8).

As a result, the developing agent enters the mixing area 303 of the confluence path 300 from the portion where the first stirring member 222 is disposed. That is, in the first modification, the developing agent moves in the direction of the arrows X7, X8 in the area of the first stirring member 222, so that the developing agent having moved to the central portion of the axial direction is returned via the confluence path 300 to the first area 221A and the second area 221B in the area of the second stirring member 223.

Therefore, since the developing agent in the first area 221A and the second area 221B is mixed by the confluence path 300 and returned to the first area 221A and the second area 221B, the developing agent in the first area 221A and second area 221B can be made uniform.

Figure 13:
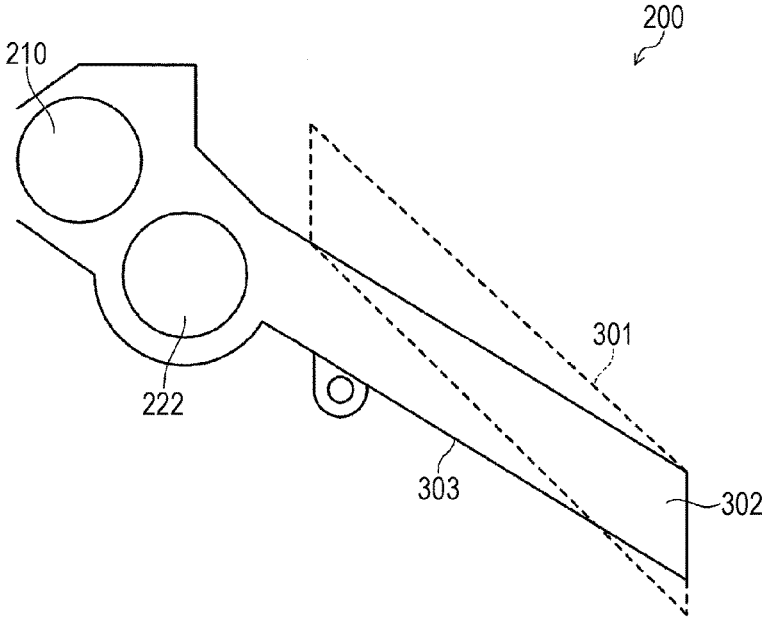
FIG. 13 is a diagram briefly showing a cross section of a mixing area portion of the developing device in FIG. 12.

As shown in FIG. 13, the mixing area 303 in this configuration extends diagonally downward to the right from the position corresponding to the first stirring member 222 of the developing agent casing 220 and is connected to the confluence area 302. As a result, the developing agent having moved to the mixing area 303 moves along the shape of the mixing area 303.

Figure 14:
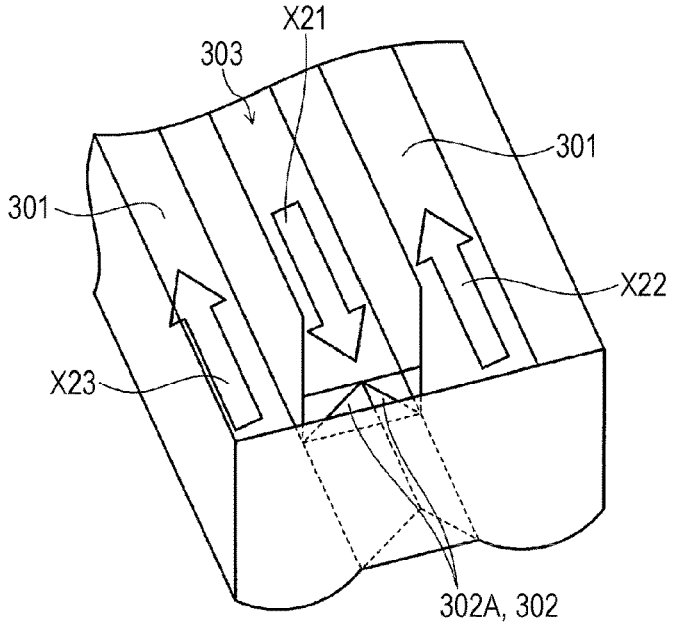
FIG. 14 is an enlarged view of a confluence area portion according to the modification of one or more embodiments of the present invention.

As shown in FIG. 14, the mixing area 303 is provided at a position higher than each conveying area 301. In the confluence area 302, an inclined surface 302A which is inclined from the center to each conveying area 301 in the portion connected to the confluence area 302 of the mixing area 303 is provided.

As a result, the developing agent (see arrow X21) moving in the mixing area 303 moves along each inclined surface 302A to each conveying area 301 and moves within each conveying area 301 (see arrows X22 and X23).

Figure 15:
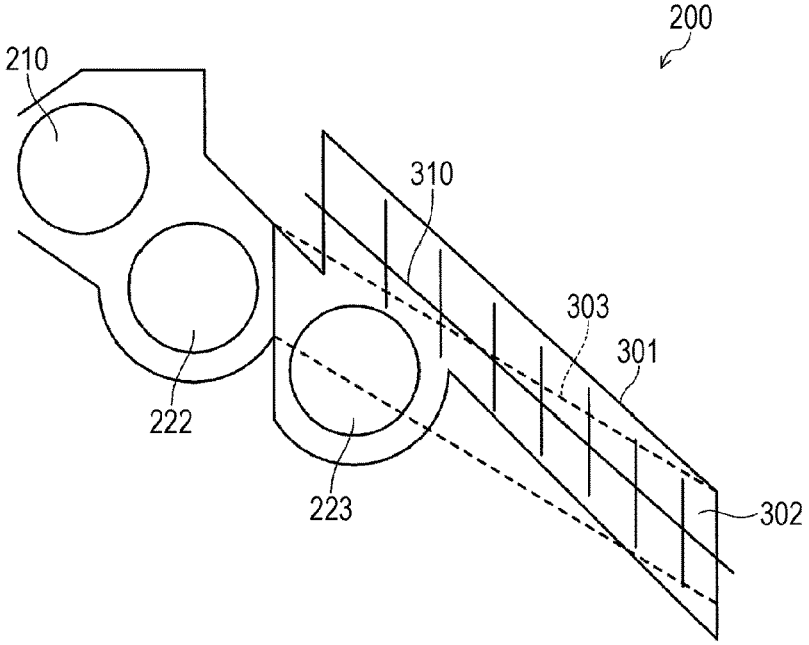
FIG. 15 is a diagram briefly showing a cross section of a conveying area portion of the developing device of FIG. 12.

As shown in FIG. 15, the conveying area 301 extends diagonally upward to the left from the confluence area 302 to the upper side of the second stirring member 223. The rotation of the conveying member 310 in the conveying area 301 causes the developing agent to be transported to the conveying area 301 and moved to the position above the second stirring member 223 and then dropped to the developing agent casing 220 by its own weight. As a result, the developing agent mixed by the confluence path 300 can be moved to the first area 221A and the second area 221B in the developing agent casing 220.

As shown in FIG. 12, the toner concentration detector 320, the toner replenisher 330 and the mixing member 340 provided in the mixing area 303 are arranged in this order in the movement direction (upward direction) of the developing agent. As a result, toner replenishment can be executed according to the detection result of toner concentration, and the developing agent after toner replenishment can be mixed in the same manner as in the above-mentioned embodiments.

Figure 16:
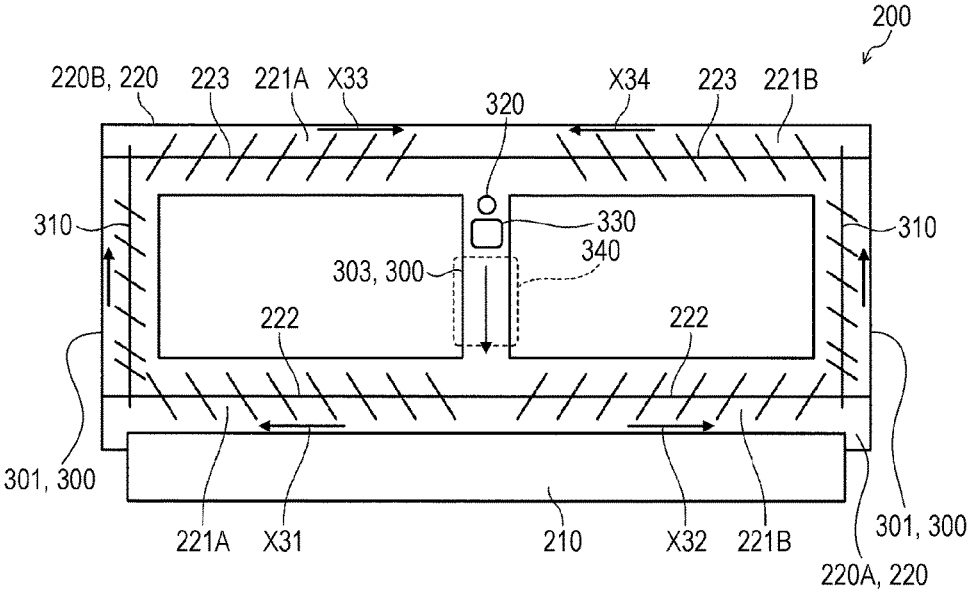
FIG. 16 is a diagram simply showing a developing device according to another modification of one or more embodiments of the present invention.

Next, the developing device 200 according to the second modification will be described. FIG. 16 is a diagram simply showing the developing device 200 according to the second modification. As shown in FIG. 16, in the developing agent casing 220 in the developing device 200 related to second modification, a first portion 220A where the first stirring member 222 is disposed and a second portion 220B where the second stirring member 223 is disposed are configured to be separated.

The confluence path 300 connects the first portion 220A and the second portion 220B at the conveying area 301 and the mixing area 303.

The conveying area 301 connects the end portion of the first portion 220A and the end portion of the second portion 220B and is provided at both ends of the first portion 220A and the second portion 220B.

Figure 17:
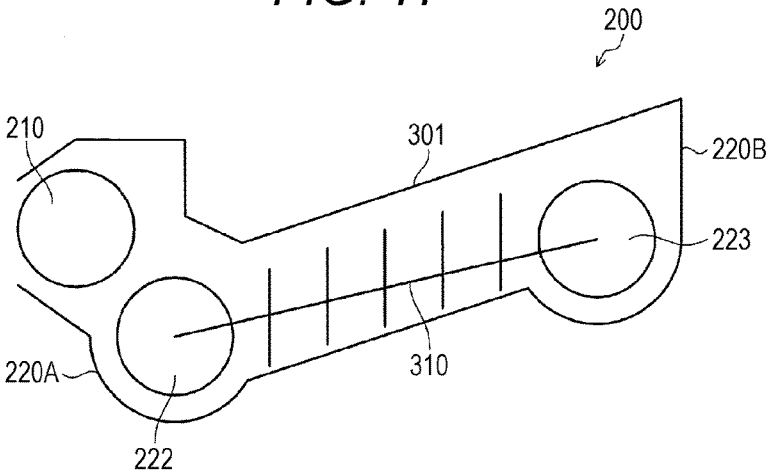
FIG. 17 is a diagram simply showing a cross section of a conveying area portion of the developing device of FIG. 16.

As shown in FIG. 17, the conveying area 301 extends diagonally upward to the right from the first portion 220A and is connected to the second portion 220B. A conveying member 310 is provided in the conveying area 301. The conveying member 310 is configured such that by rotating, the developing agent is conveyed from the first portion 220A to the second portion 220B.

Figure 18:
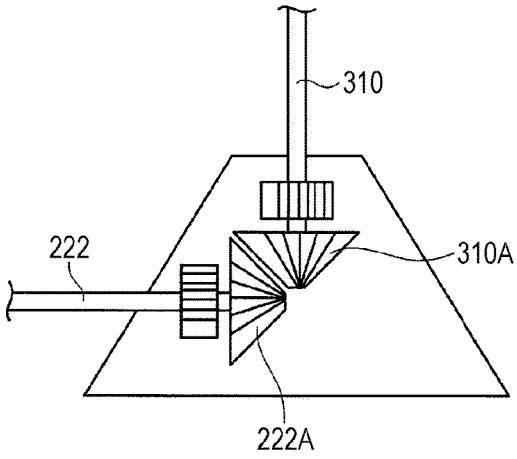
FIG. 18 is an enlarged view showing an end of a first stirring member and an end of a conveying member according to the modification of one or more embodiments of the present invention.

As shown in FIG. 18, a bevel gear 310A is provided at the end of the conveying member 310 on the side of the first stirring member 222, and a bevel gear 222A meshing with the bevel gear 310A is provided at the end of the first stirring member 222. Consequently, as the first stirring member 222 rotates, the conveying member 310 rotates. The end portion of the conveying member 310 on the side of the second stirring member 223 and the end portion of the second stirring member 223 may be provided with bevel gears that mesh with each other.

Figure 19:
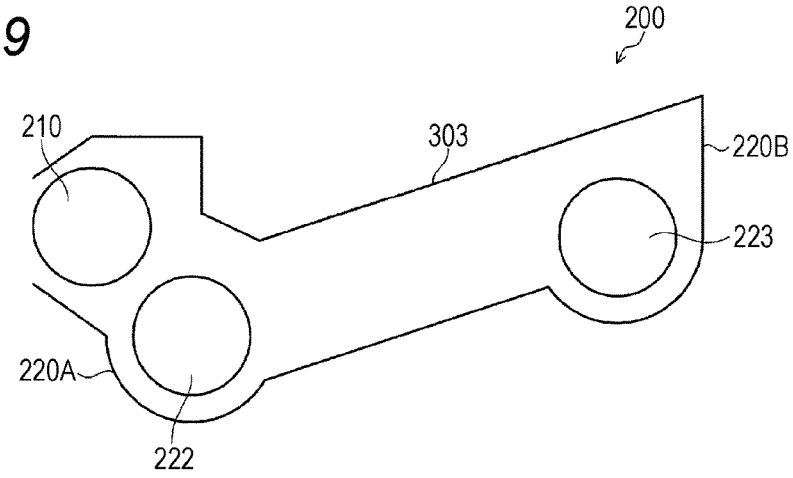
FIG. 19 is a diagram briefly showing a cross section of a mixing area portion of the developing device of FIG. 16.

As shown in FIG. 16 and FIG. 19, the mixing area 303 extends diagonally downward to the left from the central portion of the second portion 220B and is connected to the central portion of the first portion 220A. The developing agent located in the central portion of the second portion 220B moves along the shape of the mixing area 303 to the first portion 220A.

As shown in FIG. 16, the first stirring member 222 is configured to rotate and move, in each area 221A, 221B, the developing agent in the direction (see arrows X31 and X32)

from the central portion of the developing sleeve 210 in the axial direction to the end portions located of the areas 221A, 221B.

The second stirring member 223 is configured to rotate and move, in each area 221A, 221B, the developing agent in the direction (see arrows X33 and X34) from the end portions, where the areas 221A, 221B are located, of the developing sleeve 210 in the axial direction to the central portion.

As a result, in the first portion 220A, the developing agent moves in the direction of the arrows X31, X32 by the first stirring member 222, and the developing agent moves in the conveying area 301. The developing agent moves to the second portion 220B via the conveying area 301. In the second portion 220B, the developing agent moves in the direction of the arrows X33, X34 by the second stirring member 223 and is returned to the first portion 220A via the mixing area 303.

Since the mixing member (not shown) is provided in the mixing area 303, the developing agent is mixed and returned to the first area 221A and the second area 221B. Even with such a configuration, it is possible to efficiently uniformize the state of the developing agent in the entire axial direction of the developing device 200.

In the above-mentioned embodiments, the first area 221A and the second area 221B are exemplified as the plurality of movement areas. However, the present invention is not limited thereto, and a configuration having three or more movement areas may be adopted.

Besides, all of the above-mentioned embodiments are merely examples showing one or more embodiments for carrying out the present invention, and the technical scope of the present invention should not be interpreted in a limited manner. That is, the present invention can be implemented in various forms without departing from the gist or the main features thereof.

Figure 20:
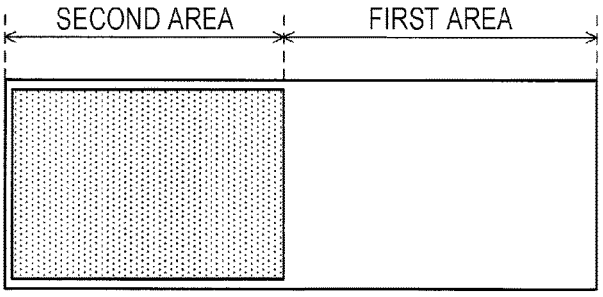
FIG. 20 is a view showing a sheet formed with a toner image having a large coverage difference between a portion corresponding to a first area and a portion corresponding to a second area according to one or more embodiments of the present invention.

Finally, an evaluation experiment of the developing device 200 according to one or more embodiments of the present invention will be described. The effectiveness of the present invention was confirmed using the developing device 200 shown in FIG. 4. More specifically, by checking the ratio of unused carriers in developing agent casing 220 using images with difference in the toner amount in the first area 221A and the second area 221B shown in FIG. 20, the effectiveness of the present invention was confirmed. In addition, a similar experiment was conducted using a developing device without a confluence path 300, that is, a configuration in which developing agent is recovered directly from the developing sleeve 210 to the developing agent casing 220 as a comparative example.

Figure 21:
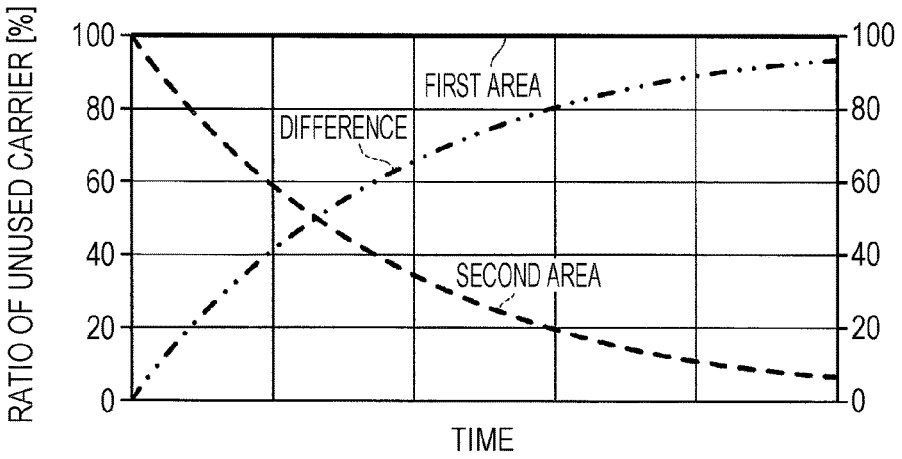
FIG. 21 shows a ratio of carriers with respect to time according to a comparative example according to one or more embodiments of the present invention.
Figure 22:
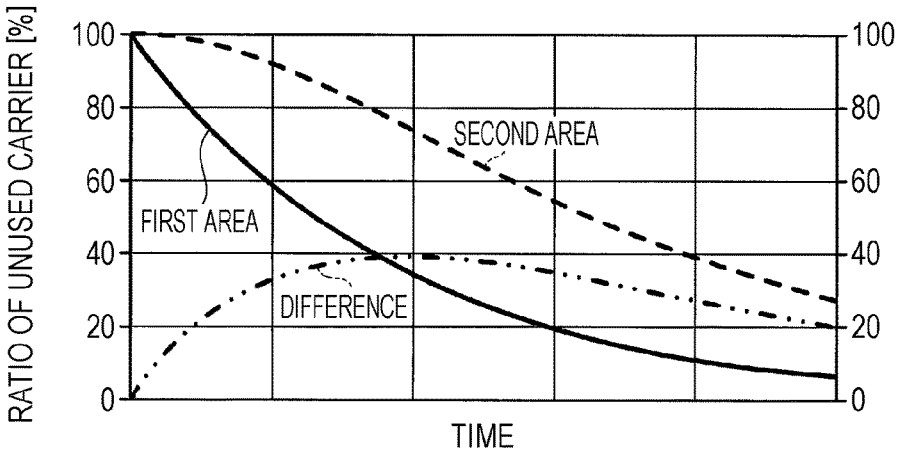
FIG. 22 shows a ratio of carrier with respect to time according to one or more embodiments of the present invention.

FIG. 21 shows a ratio of unused carriers with respect to time in the comparative example. FIG. 22 shows a ratio of unused carriers with respect to time according to one or more embodiments of the present invention.

As shown in FIG. 21, in case of comparative example, the developing agent is not consumed for the first area 221A, that is, no carrier is consumed, and therefore, the ratio of unused carriers remains at 100%. Therefore, the developing agent of the first area 221A in the developing agent casing 220 does not degrade at all.

On the other hand, for the second area 221B, since the developing agent is used in large quantities, the ratio of unused carriers decreases with the lapse of time. Therefore, the amount of deterioration of the developing agent of the second area 221B in the developing agent casing 220 increases.

Since the difference of the ratio of unused carriers between the first area 221A and the second area 221B increases as time elapses, the image concentration difference in each area increases.

On the other hand, in the developing device 200 according to one or more embodiments of the present invention, the developing agent in the first area 221A and the second area 221B is mixed by the confluence path 300. The developing agent mixed by the confluence path 300 is then supplied to each of the first area 221A and the second area 221B.

As a result, as shown in FIG. 22, the ratio of unused carriers decreases as time elapses for both the first area 221A and the second area 221B. Therefore, the difference of the ratios of unused carriers in the first area 221A and the second area 221B rises up to nearly 40% and then gradually decreases. That is, since it can be confirmed that there is no difference in the state of the developing agent in each area, the effectiveness of the present invention can be confirmed.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. A developing device comprising:

a developing sleeve that carries a developing agent;

a developing agent casing comprising a plurality of movement areas, wherein the developing agent moves through each of the movement areas to be supplied to the developing sleeve;

a confluence path in which the developing agent moving through each of the movement areas is combined and then returned to the movement areas;

a mixer that mixes the developing agent in the confluence path;

a toner replenisher, disposed in the confluence path, that replenishes a toner to the developing agent casing; and a toner concentration detector, disposed at an upstream side with respect to the toner replenisher in a movement direction of the developing agent in the confluence path, that detects a toner concentration in the developing agent.

2. The developing device according to claim 1, wherein the confluence path is provided separately for each of the movement areas.

3. The developing device according to claim 1, wherein the developing agent casing further comprises a stirrer for each of the movement areas to supply the developing agent to the developing sleeve.

4. The developing device according to claim 1, wherein the mixer resists movement of the developing agent in the confluence path.

5. The developing device according to claim 1, wherein the toner replenisher and the toner concentration detector are disposed upstream of the mixer in the movement direction.

6. The developing device according to claim 1, wherein the mixer moves the developing agent while stirring the developing agent.

7. The developing device according to claim 1, wherein the mixer moves the developing agent by scooping the developing agent.

8. The developing device according to claim 1, wherein the mixer moves the developing agent by causing the developing agent to meander.

9. The developing device according to claim 1, wherein the confluence path extends in a direction substantially perpendicular to an axial direction of the developing sleeve.

10. The developing device according to claim 1, wherein the confluence path and the developing agent casing are different in height.

11. An image forming device comprising:

a developing sleeve that carries a developing agent;

a developing agent casing comprising a plurality of movement areas, wherein the developing agent moves through each of the movement areas to be supplied to the developing sleeve;

a confluence path in which the developing agent moving through each of the movement areas is combined and then returned to the movement areas;

a mixer that mixes the developing agent in the confluence path;

a toner replenisher, disposed in the confluence path, that replenishes a toner to the developing agent casing; and a toner concentration detector, disposed at an upstream side with respect to the toner replenisher in a movement direction of the developing agent in the confluence path, that detects a toner concentration in the developing agent.

* * * * *